US005470303A

United States Patent [19]

Leonard et al.

[11] Patent Number: 5,470,303

[45] Date of Patent: Nov. 28, 1995

[54] MASSAGE DEVICE

[75] Inventors: Cynthia D. Leonard; Lawrence Gayne, both of North York, Canada

[73] Assignee: C. L. Femme Inc., North York

[21] Appl. No.: 221,665

[22] Filed: Apr. 1, 1994

[51] Int. Cl.[6] ..... A61H 1/00

[52] U.S. Cl. ..... 601/84; 601/87; 601/112; 600/38

[58] Field of Search ..... 601/84, 85, 87, 601/88, 89, 93, 94, 95, 112, 113, 114, 101, 136, 137, 46; 446/352, 353, 354; 600/38

[56] References Cited

U.S. PATENT DOCUMENTS

| | | | |
|---|---|---|---|
| 2,194,537 | 3/1940 | Adams | 446/353 |
| 3,451,391 | 6/1969 | Tavel . | |
| 3,504,665 | 4/1970 | Bakunin . | |
| 3,945,076 | 3/1976 | Sung | 601/87 |
| 3,978,851 | 9/1976 | Sobel | 601/95 |
| 3,991,751 | 11/1976 | O'Rourke . | |
| 4,033,338 | 7/1977 | Igwebike | 601/6 |
| 5,067,480 | 11/1991 | Woog et al. . | |

FOREIGN PATENT DOCUMENTS

| | | | |
|---|---|---|---|
| 215519 | 3/1987 | European Pat. Off. | 601/87 |
| 334373 | 9/1930 | United Kingdom | 446/352 |

*Primary Examiner*—Robert A. Hafer
*Assistant Examiner*—David J. Kenealy
*Attorney, Agent, or Firm*—George A. Seaby

[57] ABSTRACT

Conventional massage devices of the sexual self-stimulator type include reciprocating massage heads. Some devices of this type feature rotary massage heads. A novel device includes a housing containing a drive and carrying a soft, flexible, resilient, tongue-shaped head on one end thereof, the head containing an arcuate shaft with a straight inner end connected to the drive, whereby the path of travel of the shaft during rotation defines an ellipsoid with a cone on the outer free end thereof.

5 Claims, 11 Drawing Sheets

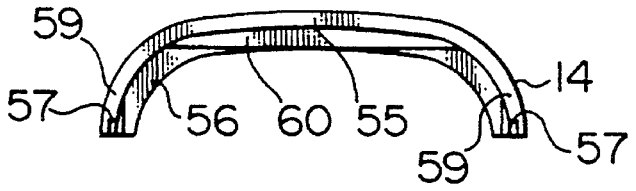
FIG. 14
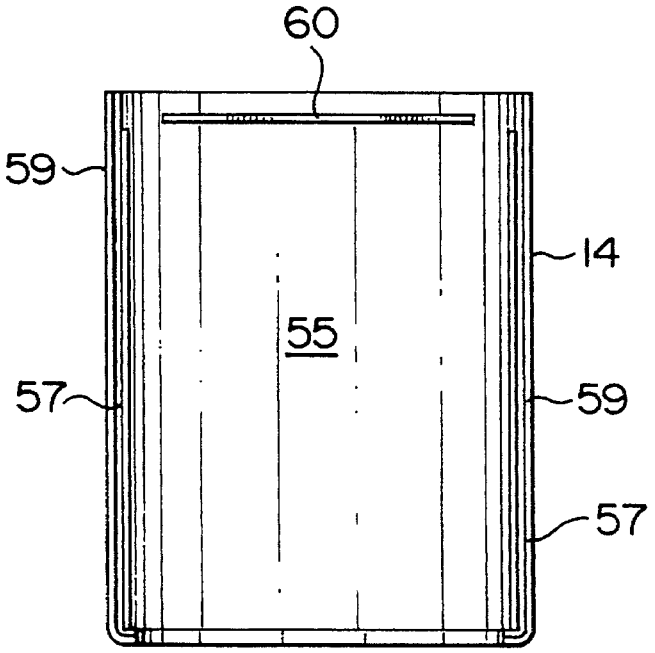
FIG. 12
FIG. 13
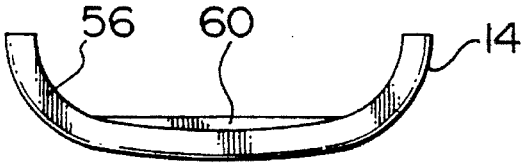

MASSAGE DEVICE

BACKGROUND OF THE INVENTION

1. Field of the Invention

This invention relates to a massage device and in particular to a sexual self-stimulator for use by women.

2. Discussion of the Prior Art

Sexual self-stimulators, principally in the form of vibrators, have been available for a long time. Examples of such devices are described in a substantial volume of patent literature, including U.S. Pat. Nos. 3,451,391, which issued to J. H. Tavel on Jun. 24, 1969; 3,504,665, which issued to M. I., Bakunin et al on Apr. 7, 1970; 3,991,751, which issued to J. O. O'Rourke on Nov. 16, 1976; 4,033,338, which issued to K. Igwebiki on Jul. 5, 1977 and 5,067,480, which issued to P-G. E. Woog et al on Nov. 16, 1991. The Woog et al patent contains a more or less complete dissertation of the need for sexual stimulators for use by women. Particular reference is made to column 1, line 9 to column 2, line 25 of the patent which is incorporated herein by reference. Studies conducted by the present inventors merely served to reinforce their belief in the need for such sexual stimulators.

There are two major considerations with respect to device of this type, namely appearance and the manner in which the business end of the device moves. The patented devices have one feature in common with each other and with the device of the present invention, namely they all utilize a massage head which rotates rather than reciprocating. However, in spite of the advances which have been made in the art in question, the present inventors have found that there is still a need for a massage device of the self-stimulator type which is aesthetically pleasing, and which stresses an interesting manner of movement, as opposed to speed.

GENERAL DESCRIPTION OF THE INVENTION

An object of the present invention is to meet the above defined need by providing a massage device which is relatively simple in terms of structure, and which has an interesting shape and manner of movement.

Another object of the invention is to provide a drive for a massage device which is easy to assemble, and which imparts a relative slow speed of movement to a massage head.

Accordingly, the present invention relates to a massage device comprising housing means for manual manipulation of the device; elongated, flexible, resilient massage head means on one end of said housing means; arcuate shaft means in said head means, said shaft means extending longitudinally of said head means substantially the entire length thereof; drive means in said housing means connected to an inner end of said shaft means for rotating said shaft means around an axis of rotation parallel to the longitudinal axis of said housing means, whereby an outer end of said shaft means moves in a circle around said axis of rotation to impart a rotary motion to said massage head.

BRIEF DESCRIPTION OF THE DRAWINGS

The invention is described hereinafter in greater detail with reference to the accompanying drawings, which illustrate a preferred embodiment of the invention, and wherein:

FIG. 12 is a top view of a front lower casing section used in the device of FIGS. 1 to 6;

FIG. 13 is an end view of the housing section of FIG. 12 as viewed from the bottom thereof;

FIG. 14 is an end view of the housing section of FIG. 12 as seen from the top thereof;

DESCRIPTION OF PREFERRED EMBODIMENT

Figure 2:
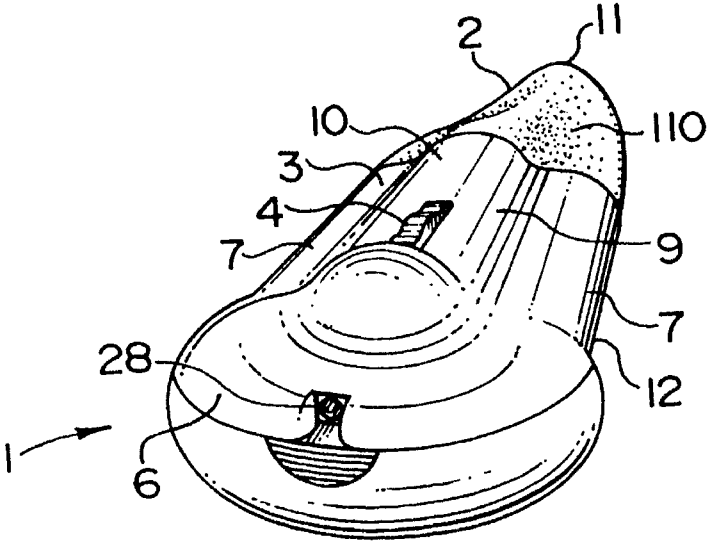
FIG. 2 is a perspective view of the massage device of FIG. 1 from the rear end thereof.
Figure 1:
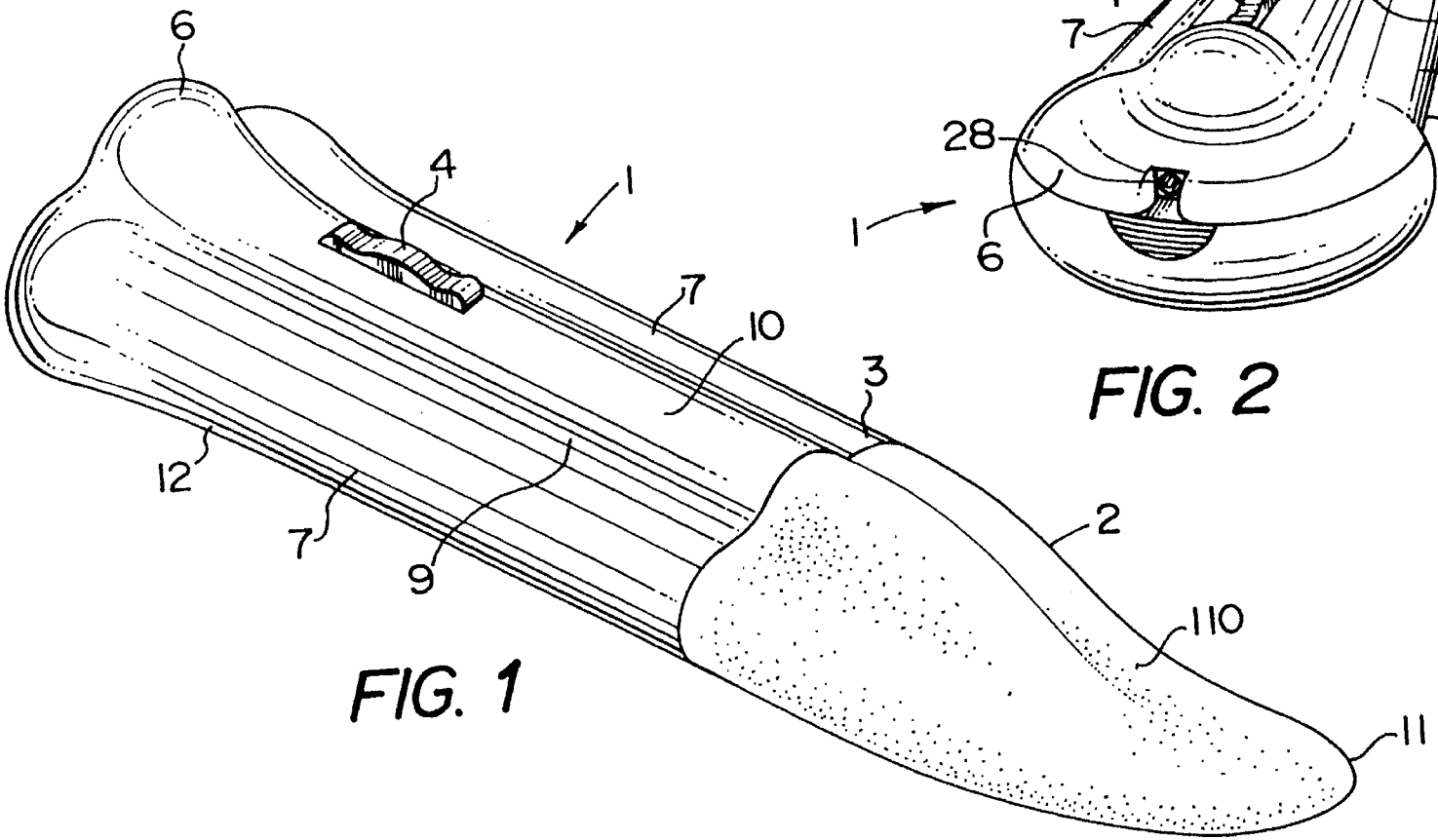
FIG. 1 is a perspective view of a massage device in accordance with the present invention from one side and above.
Figure 3:
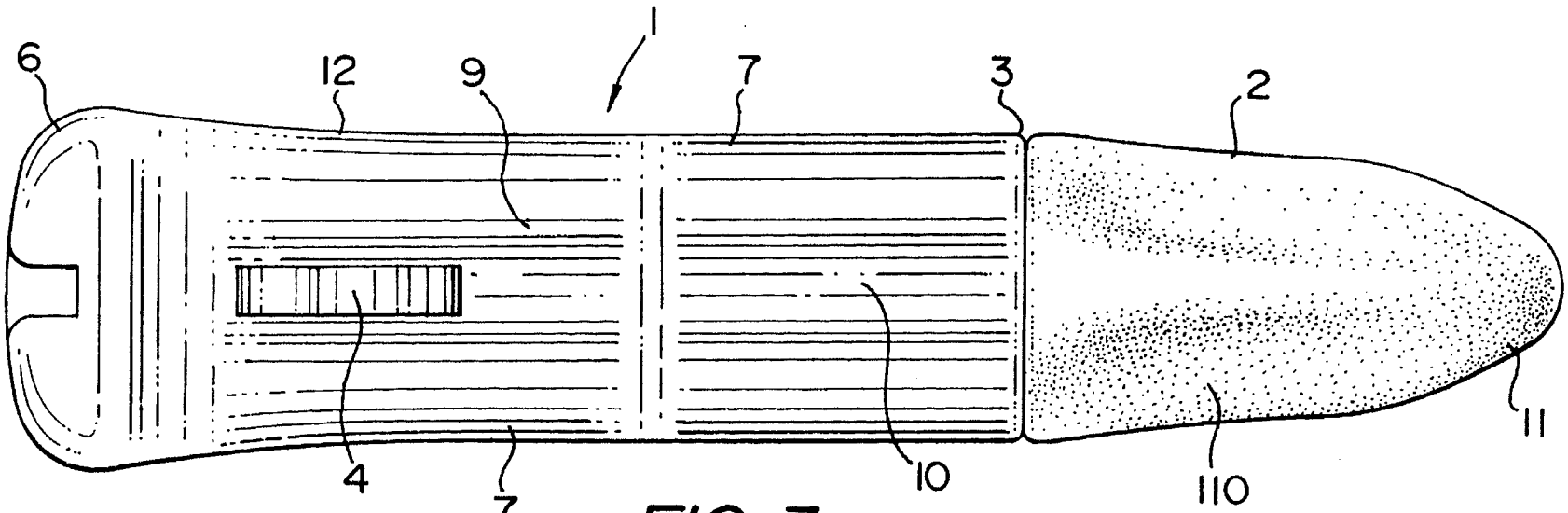
FIG. 3 is a top view of the massage device of FIG. 1 from the rear thereof.
Figure 4:
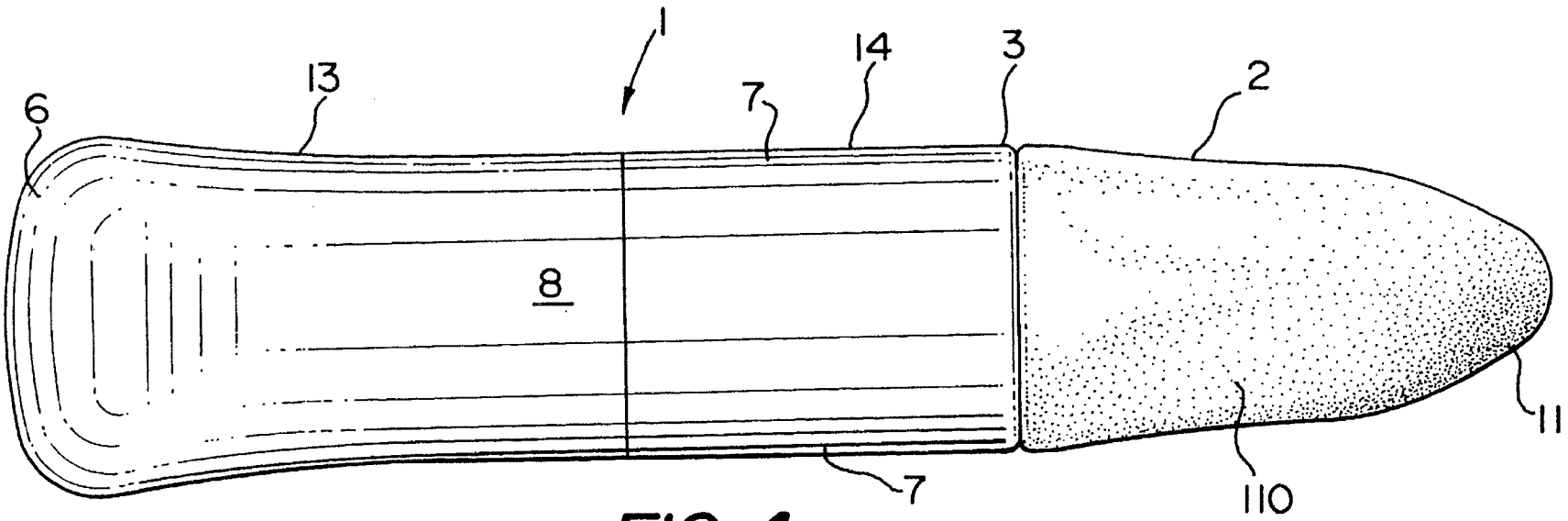
FIG. 4 is a bottom view of the device of FIGS. 1 to 3.
Figure 5:
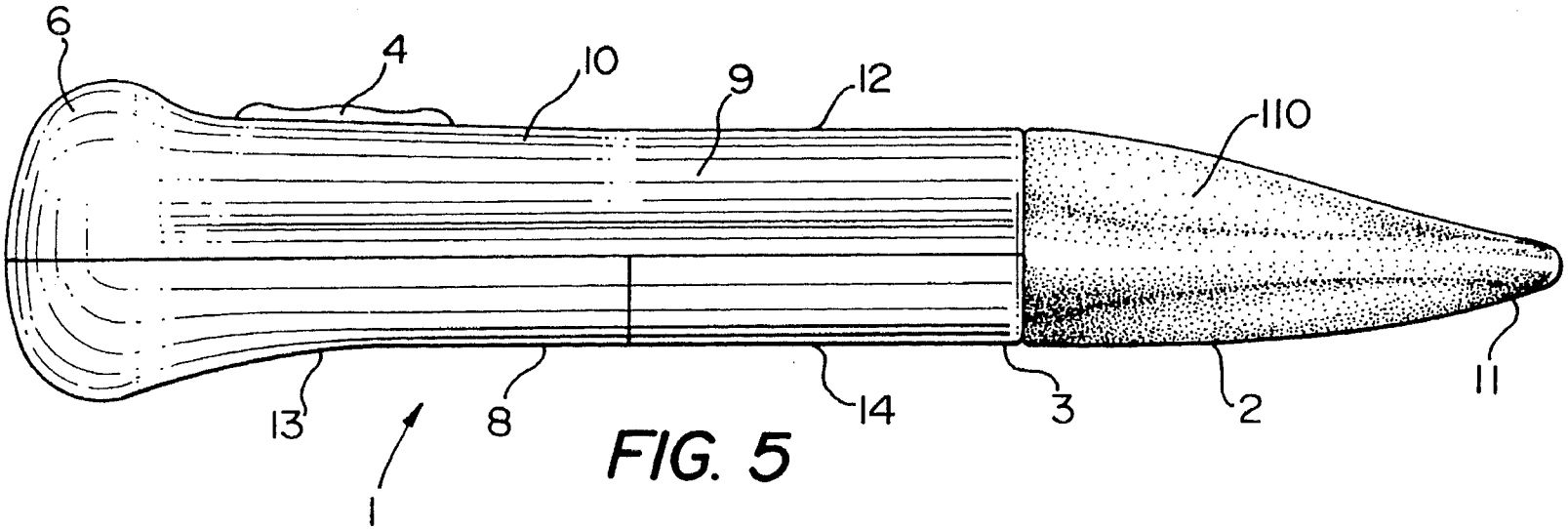
FIG. 5 is a side view of the massage device of FIGS. 1 to 4.
Figure 6:
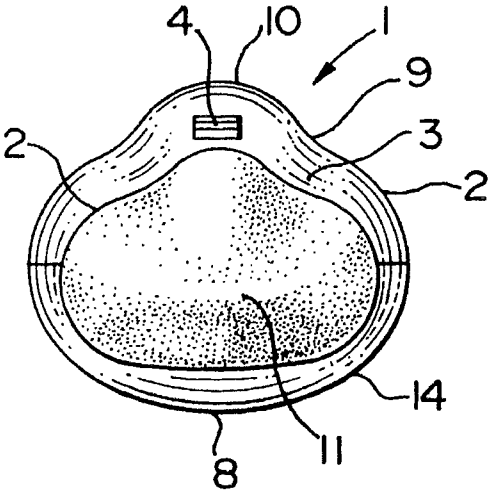
FIG. 6 is a front end view of the massage device of FIGS. 1 to 5.

With reference to FIGS. 1 to 6, the exterior of the massage device is defined by a housing, which is generally indicated at 1 and a massage head 2 connected to one end 3 of the housing. The only other external feature of any importance is a slide switch 4 mounted on the top center of the housing 1 near the rear thereof. The housing 1 has a bulbous rear end 6 and a generally elliptical cross section body with parallel sides 7, a smooth convex bottom surface 8 and a wavy top surface 9 dominated by a central convex ridge or projection 10 extending the entire length of the top surface with the switch 4 in the center thereof. The tongue-shaped massage head 2 forms a continuation of the front end of the housing 1, tapering forwardly to a rounded outer or front free end 11.

Figure 7:
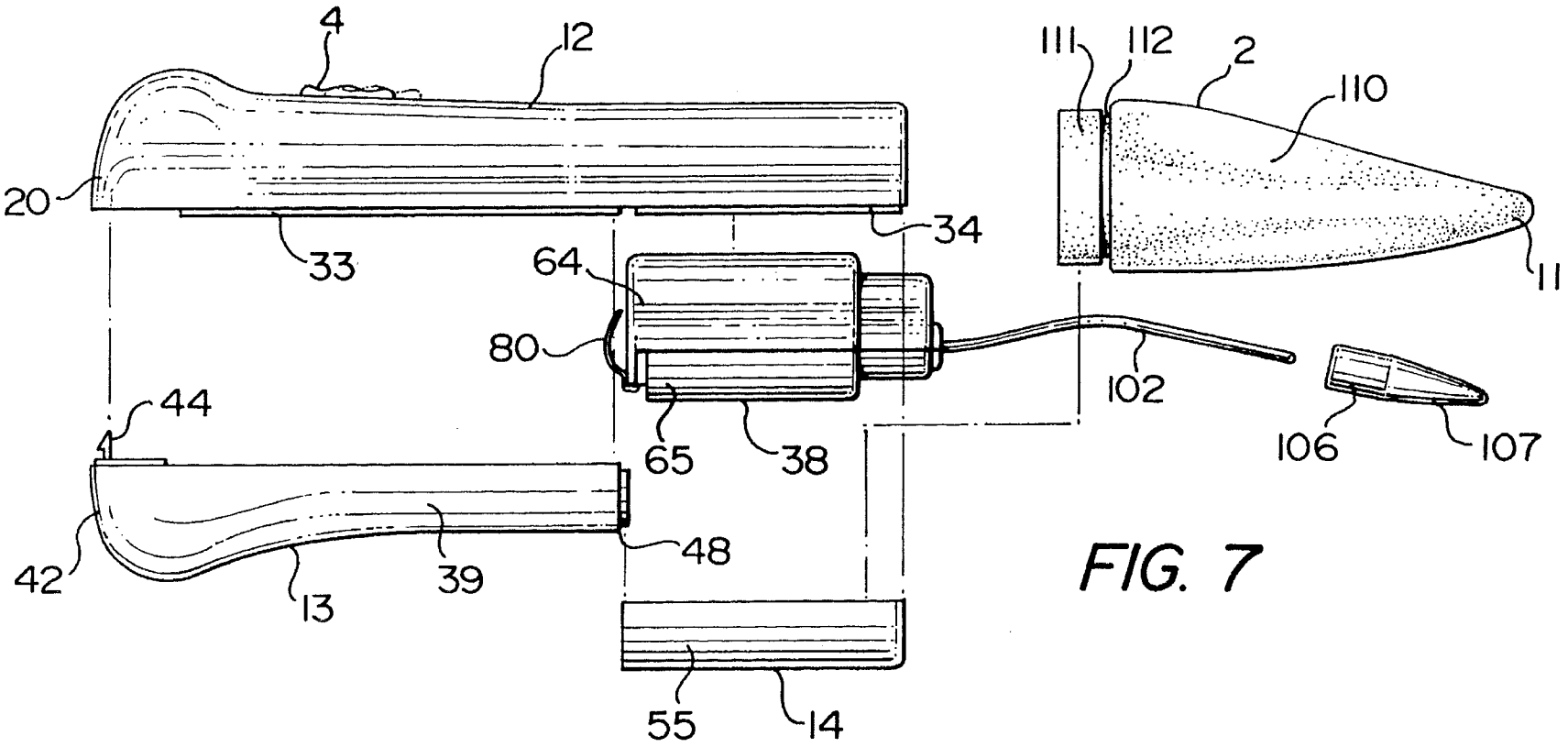
FIG. 7 is an exploded, side view of the principal components of the massage device of FIGS. 1 to 6.

As best shown in FIG. 7, the housing 1 is defined by a single upper section 12 and rear and front lower sections 13 and 14, respectively. The interior of the housing defines a rear battery chamber 15 (FIG. 8) and a front drive chamber 16. A partition or wall 18 extends transversely of the upper housing section 12 near but spaced apart from the rear wall 20 thereof. The partition 18 is reinforced by gussets 21. Battery terminals 23 are mounted on the partition 18. A pair of parallel, spaced apart partitions 25 extend longitudinally of the upper housing section 12. A printed circuit board 27 is mounted between the partitions 25. A jack 28 (FIG. 2) is provided in the rear end of the top section 12 of the housing for connecting the printed circuit to a source of 115 V alternating current. Batteries 29 are placed in the housing 1 and centered by the partitions 25 and small gussets 31 extending outwardly from the sides of the upper housing section 12. Flanges 33 and 34 extend downwardly from the inner edges of the sides of the upper housing section 12 for aligning the housing sections during assembly. An inwardly extending flange 35 (FIG. 8) at the open front end 3 of the housing section 12 helps to retain the massage head 2 in position. Opposed, transversely extending arms 36 near the open front end help to position a drive casing 38 in the housing 1.

Figure 8:
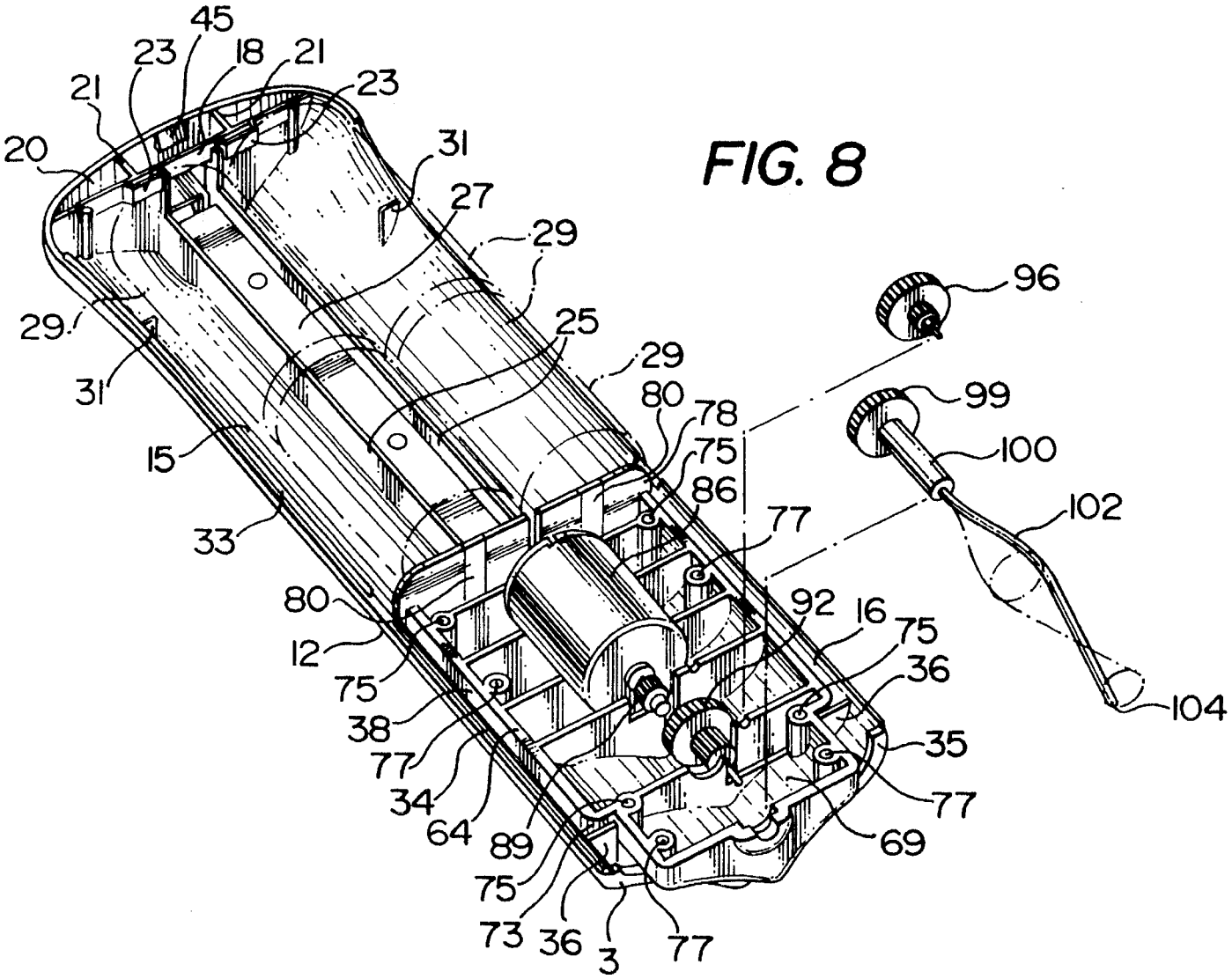
FIG. 8 is a partially exploded, perspective view of an upper housing section used in the device of FIGS. 1 to 6.
Figure 9:
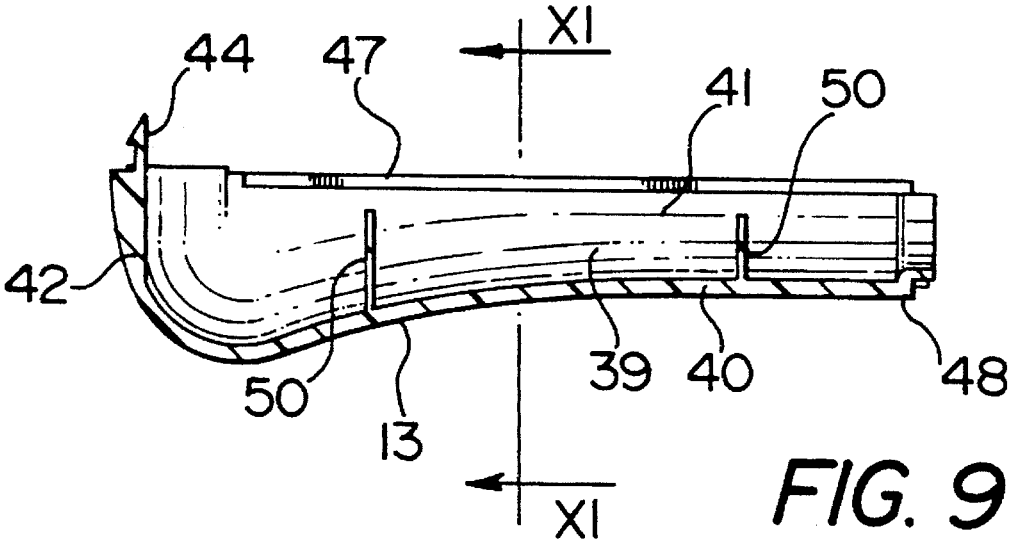
FIG. 9 is a longitudinal sectional view of a rear lower housing section used in the device of FIGS. 1 to 6.
Figure 11:
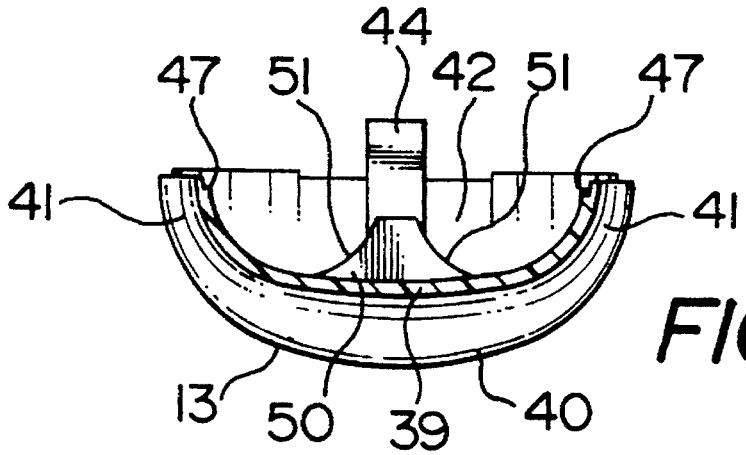
FIG. 11 is a cross section taken generally along line XI—XI of FIG. 9.
Figure 10:
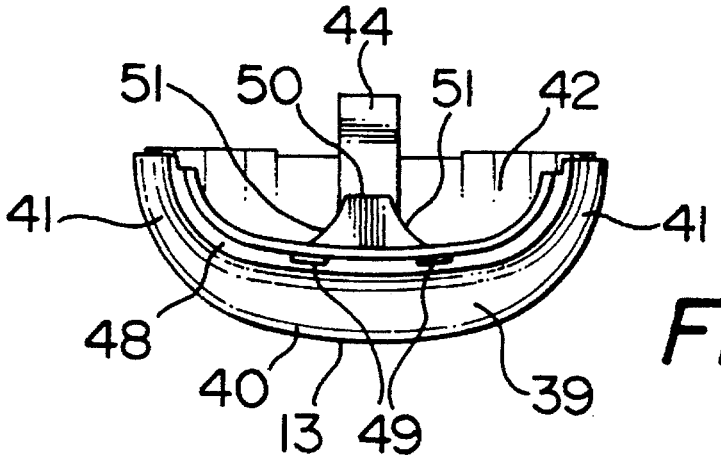
FIG. 10 is an end view of the housing section of FIG. 9 as viewed from the right thereof.

Referring to FIGS. 9 to 11, the rear, lower housing section 13 is defined by an elongated hollow body 39, including a bottom wall 40, side walls 41 and a rear end wall 42 integral with the top wall 40. A resilient hook 44 extends upwardly from the center of the rear wall 42. When the housing 1 is initially assembled or reassembled after replacing the batteries 29, the hook 44 snaps onto a small projection 45 (FIG. 8) in the center of the rear wall 21 of the upper housing section 12. Recesses 47 are provided in the top inner edges of the side walls 41 for receiving the flanges 33 extending downwardly from the sides of the upper housing section 12. A shoulder 48 extends around the open front end of the body 39 for sliding under the rear end of the front bottom housing section 13 when the housing is closed. Small projections or dimples 49 are provided on the shoulder 48 for ensuring a friction fit between the lower housing sections 13 and 14. A pair of thin partitions 50 with concave depressions 51 therein extend upwardly form the bottom wall 40 of the housing section 13 for stabilizing the batteries 29 in the housing 1.

The front lower housing section 14 (FIGS. 12 to 14) includes an elongated body 55 of concavo-convex cross section with an inwardly extending flange 56 at the front end thereof for retaining the massage head 2 in the housing. Recesses 57 are provided in the sides 59 of the body 55 for receiving the front flanges 34 on the sides of the upper housing section 12. A small wall 60 extends transversely of the interior of the body 55 near the rear end thereof for limiting inward movement of the rear lower housing section 13 when the latter is placed over the batteries 29. It will be appreciated that the rear lower housing section 13 is, in effect, a battery cover.

Figure 16:
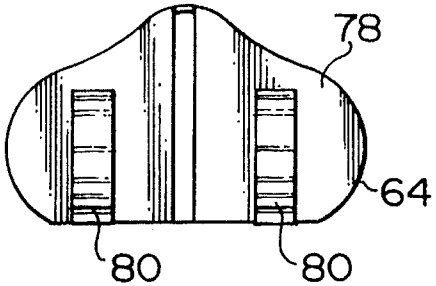
FIG. 16 is an end view of the casing of FIG. 15 as viewed from the left thereof.
Figure 18:
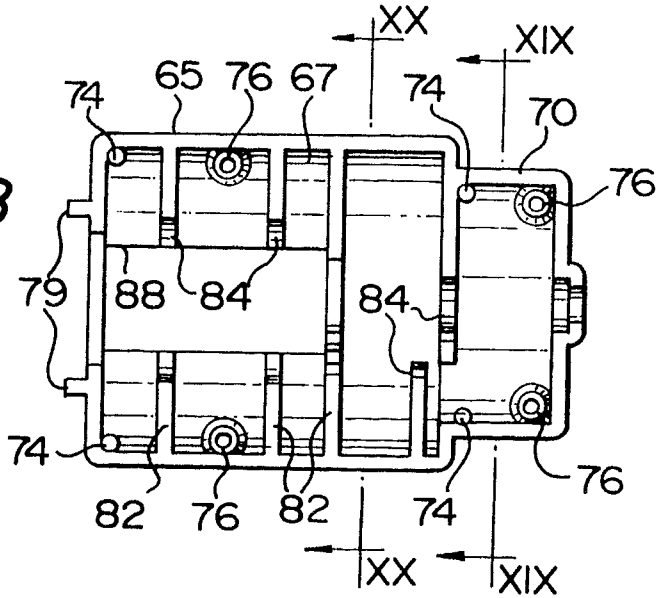
FIG. 18 is a top view of the bottom casing section of FIG. 17.
Figure 15:
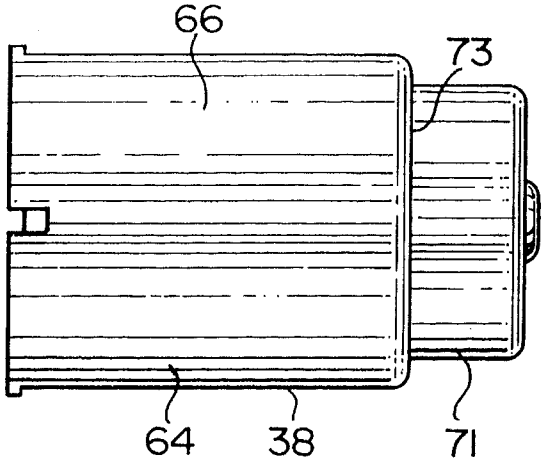
FIG. 15 is a top view of a drive casing used in the device of FIGS. 1 to 6.
Figure 17:
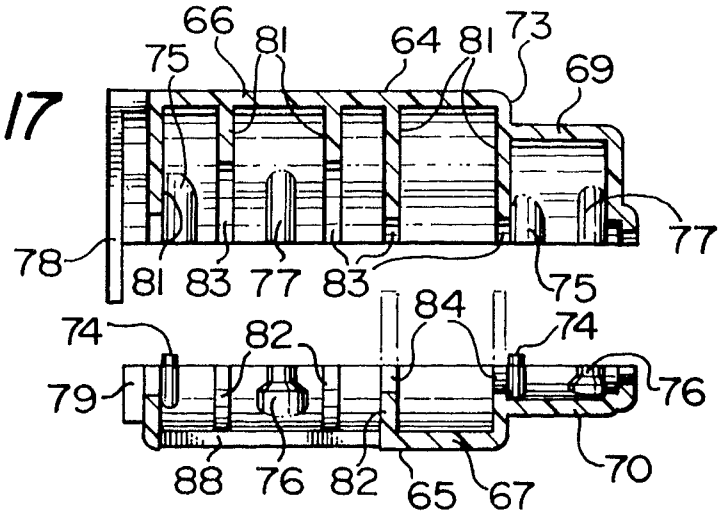
FIG. 17 is an exploded, longitudinal sectional view of the casing of FIG. 15.
Figure 21:
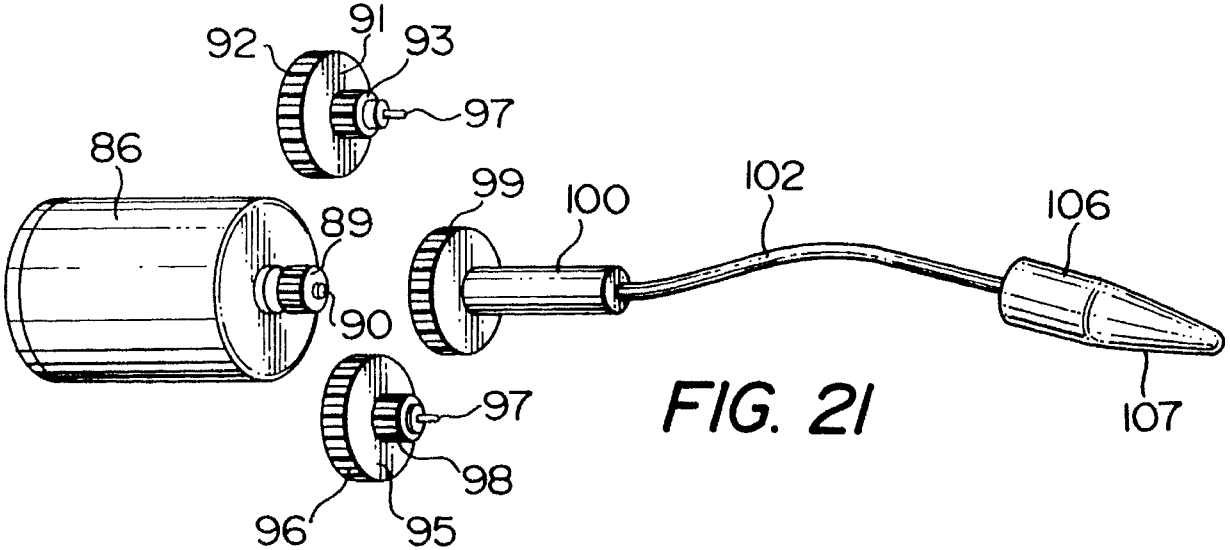
FIG. 21 is an exploded, perspective view of the drive used in the device of FIGS. 1 to 6.
Figure 23:
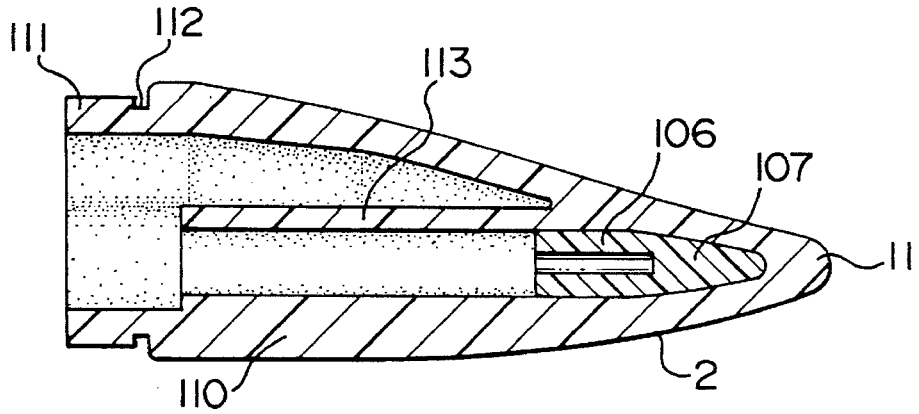
FIG. 23 is a longitudinal sectional view of a massage head used in the device of FIGS. 1 to 6.
Figure 24:
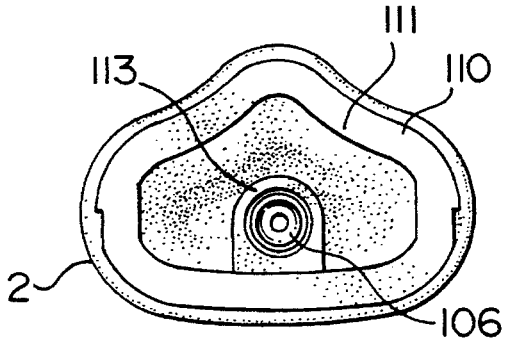
FIG. 24 is an end view of the massage head of FIG. 23 as viewed form the left thereof.

With reference to FIGS. 8 and 15 to 20, the two-piece drive casing 38 is provided in the front end of the housing 1 for carrying the drive elements of the device. The casing 38 includes top and bottom sections 64 and 65, respectively which are interconnected in much the same manner as the housing sections 12, 13 and 14. The casing sections 64 and 65 are defined by thin walled bodies 66 and 67, respectively, the front ends of which include necks 69 and 70, respectively, which define a hollow neck 71 (FIG. 15) extending forwardly out of the front end of the housing 1 when the device is assembled. The dimensions of the neck 71 are smaller than those of the opening in the front end of the housing 1 for admitting the rear end of the massage head 2 between the neck 71 and the housing 1. The casing 38 is positioned in the housing 1 by the arms (FIG. 8) extending outwardly from the sides of the upper housing section 12 which abut a shoulder 73 at the rear end of the neck 69 of the top casing section 64. Small cylindrical lugs 74 extend upwardly from the lower casing section 65 into sleeves 75 in the upper casing section 64 for aligning the two sections. The two sections 64 and 65 are held together by self-tapping screws (not shown) which are screwed into aligned sleeves 76 and 77 in the lower and upper casing sections 64 and 65, respectively. The rear end of the upper casing section 64 overlaps the rear end of the lower section 64, and an elongated end wall 78 on the upper section defines a partition between the battery and drive areas of the housing 1. Arms 79 extend outwardly from the rear end of the lower casing section 65 for maintaining the correct positions of the sections with respect to each other. The wall 78 carries a pair of battery terminals 80 (FIG. 16). A plurality of partitions 81 and 82 extend transversely of the casing sections 64 and 65, respectively. Concave grooves 83 and 84 are provided in the partitions 81 and 82 for receiving a motor 86 and a transmission generally indicated at 87 (FIG. 21). An opening 88 in the lower casing section 65 ensures proper ventilation of the motor 86.

Figure 22:
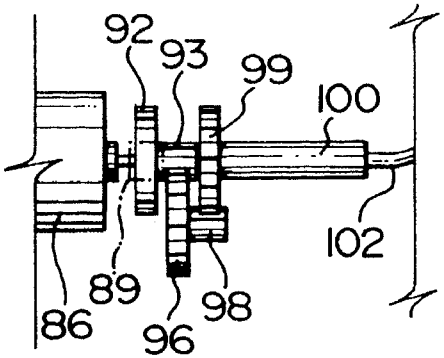
FIG. 22 is a plan view of a portion of the drive of FIG. 21 in assembled condition.
Figure 20:
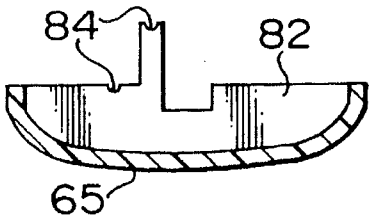
FIGS. 19 and 20 are cross sections taken generally along lines XIX—XIX and XX—XX, respectively of FIG. 18.
Figure 19:
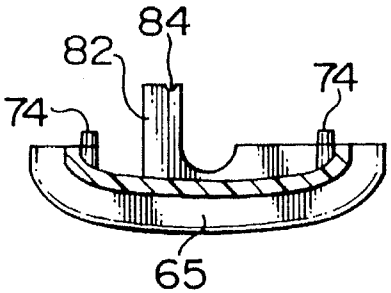

As best shown in FIGS. 8 and 21, a small gear 89 is mounted on the shaft 90 of the motor 86. The gear 89 meshes with the large diameter rear end 91 of a spur gear 92. The small diameter front end 93 of the gear 92 meshes with the larger diameter rear end 95 of a second spur gear 96, which is identical to the gear 92. Each gear 92 and 96 includes small shafts 97 (one shown on each gear) extending outwardly therefrom for rotatably supporting the gear in the smaller of the concave grooves 84 in the partitions 82 of the lower casing section 65. The small diameter front end 98 of the gear 96 meshes with a larger gear 99 on the rear end of a sleeve 100, which carries a wand or rod 102 located in the massage head 3. As best shown in FIG. 22, the use of the gear train described above results in a relatively lightweight, compact structure. The rod 102 includes a straight rear or inner end (not shown) co-axial with and contained in the sleeve 100, and an arcuate outer end 103 (FIG. 8). The tip 104 of the rod 102 is eccentric with respect to the straight inner end thereof, i.e. an extension of the longitudinal axis of the straight inner end of the rod 102 is intersected by the rod inwardly of the tip 104 thereof. Thus, rotation of the rod 102 around the longitudinal axis of the straight inner end thereof causes rotation of the tip 104 in a small circle around such axis, while the outermost point on the arc defined by the rod 102 describes a relatively large circle during rotation. A hard plastic tip 106 with a tapering outer free end 107 is mounted on the outer end 103 of the rod 102, so that the latter does not damage the material used in the massage head 2.

The massage head 2 (FIGS. 1, 3 to 6, 23 and 24) includes an elongated body 110 formed of a soft, resilient, flexible material, namely a thermoplastic rubber. A plurality of small projections (not shown) are provided on the substantially entire surface of the body 10, except for the edges and the tip thereof. For the most part the body 110 is hollow with an open rear end 111 with approximately the same dimensions as the neck of the casing 62, so that the head 2 can be slid onto the neck. A groove 112 extends around the periphery of the reduced diameter rear end 111 for receiving the flanges 56 and on the upper and front lower housing sections 12 and 14, respectively, which retain the head 2 in the housing 1. An interior sleeve 113 in the body 100 receives the plastic tip 106 and a major portion of the rod 102.

Figure 25:
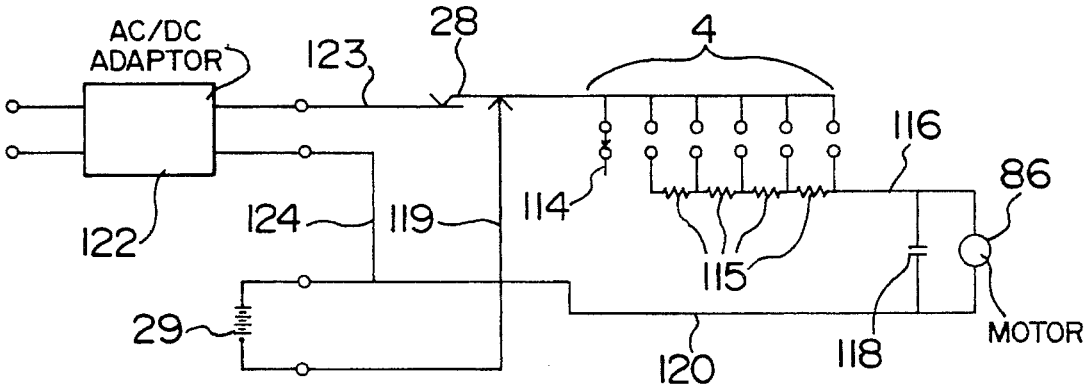
FIG. 25 is a schematic, block diagram of an electrical circuit used in the device of FIGS. 1 to 6.

Referring to FIG. 25, actuation of the motor 86 is controlled by the switch 4 and a circuit mounted on the board 27. The circuit includes the slide switch 4, which has an "off" position 114 and five other speed positions. Four 1.5 ohm resistors 115 between each speed control switch terminal control the current fed via wire 116 to the motor 86 and consequently the speed of rotation of the rod 102. A 0.1 μF capacitor 118 is provided between the switch 4 and the motor 86 for extending the life of the motor. Power for the motor 86 is supplied by four "C" size batteries 29 via wires 119 and 120, the switch 4 and wire 116. Alternatively, the jack 28 is connected to a source of 115 volt AC power via an AC/DC adaptor 122 (which does not form part of this invention) and leads 123 and 124, and the jack 28 (FIG. 2).

In operation, when the switch 4 is moved to one of the "on" positions, the motor 86 is actuated to rotate the shaft 102 at a speed dependent upon the motor position. While other speed reductions can be utilized, the particular gear train illustrated in the drawings utilizes large gears having twenty-eight teeth and small gears having ten tenth. Thus, the speed reduction from the gear 89 to the large end 91 of the spur gear 92, from the small end 93 of the gear 91 to the large end 95 of the gear 96, and from the small end 98 of the gear 96 to the gear 99 on the shaft 102 is 2.8 in each case. Thus, if the motor shaft rotates at 7760 rpm, the shaft 102 will rotate at 353 rpm. As illustrated in FIG. 8, because the tip 104 of the shaft 102 is eccentric with respect to the longitudinal axis of the straight inner end of the shaft, the arcuate outer end of the shaft travels through an arc defining an elongated ellipsoid with a cone on the outer end thereof. Of course, this creates a corresponding distortion or movement of the massage head 2.

We claim:

1. A massage device comprising housing means for manual manipulation of the device, said housing means having an open front end and a closed rear end; drive means in said housing means; elongated shaft means including a straight inner end connected to said drive means and defining an axis of rotation parallel to the longitudinal axis of said housing means, an arcuate outer end extending longitudinally out of said open end of the housing means, and a tip on said outer end of said shaft means which is eccentric with respect to said straight inner end, whereby, when said drive means is actuated, the tip of said shaft means moves in a circle around the axis of rotation, and the arcuate outer end travels through an arc defining an ellipsoid with a cone on the outer end thereof; elongated, flexible, resilient, tongue-shaped massage head means, said massage head means including an open rear end mounted in and closing said open front end of the housing means, a closed front end, and sleeve means defining an enclosure of a portion of the inner area of said head means, said sleeve means extending from the closed end substantially the entire length of said head means for snugly receiving said tip means, whereby said head means moves smoothly with said shaft means and damage to said head means during rotation of said shaft means is prevented.

2. A massage device according to claim 1, including inwardly extending flange means in said open front end of said housing mean; and groove means extending around said open rear end of said massage head means for receiving said flange means.

3. A massage device according to claim 1, wherein said drive means includes motor means; and transmission means connecting said motor means to said shaft means, said transmission means including first circular gear means connected to said motor means, first spur gear means connected to said first circular gear means; second spur gear means connected to said first spur gear means; and second circular gear means on said inner end of said shaft means connected to said second spur gear means, said gear means successively reducing the speed of rotation between said motor means and said shaft means.

4. A massage device according to claim 2, including casing means in said front end of said housing means carrying said drive means and slidably receiving the open rear end of said massage head means for locating the massage head means in said housing means.

5. A massage device according to claim 4, wherein said housing means includes an upper housing section, a front lower housing section carrying said casing means and a removable rear lower casing section.

* * * * *